United States Patent [19]

Walker et al.

[11] Patent Number: 4,850,725

[45] Date of Patent: Jul. 25, 1989

[54] UNIDIRECTIONAL RIBBON DRIVE MECHANISM

[75] Inventors: Alan H. Walker, Barton; Bradley W. Lewis, Spencer; Thomas J. Bossack, Candor, all of N.Y.

[73] Assignee: NCR Corporation, Dayton, Ohio

[21] Appl. No.: 206,784

[22] Filed: Jun. 15, 1988

[51] Int. Cl.[4] ..... B41J 33/22

[52] U.S. Cl. ..... 400/236.2; 400/196.1; 400/208; 400/233; 400/234; 74/354

[58] Field of Search ..... 400/194, 195, 196, 196.1, 400/207, 208, 208.1, 221, 221.1, 221.2, 227, 229, 233, 236.2, 234; 74/354, 810

[56] References Cited

U.S. PATENT DOCUMENTS

| | | | |
|---|---|---|---|
| 3,241,385 | 3/1966 | Tomaro, Jr. | 74/354 |
| 3,923,267 | 12/1975 | Eckerd et al. | 400/221.2 X |
| 3,948,382 | 4/1976 | Nesbitt et al. | 400/202.4 |
| 3,954,167 | 5/1976 | Kranz et al. | 400/221.2 X |
| 3,990,564 | 11/1976 | Crump et al. | 400/222 |
| 4,342,520 | 8/1982 | Isobe et al. | 400/221 |
| 4,416,560 | 11/1983 | Wood et al. | 400/705.1 |
| 4,452,542 | 6/1984 | Akazawa | 400/175 |
| 4,526,486 | 7/1985 | Kikuchi et al. | 400/229 X |
| 4,531,849 | 7/1985 | Dobashi | 400/229 |
| 4,596,480 | 6/1986 | Takada | 400/229 |
| 4,712,931 | 12/1987 | Ohshima | 400/196.1 |

FOREIGN PATENT DOCUMENTS

| | | | |
|---|---|---|---|
| 0097566 | 1/1984 | European Pat. Off. | 400/236.2 |
| 0078791 | 5/1983 | Japan | 400/196.1 |
| 0191182 | 11/1983 | Japan | 400/236.2 |
| 0087085 | 5/1985 | Japan | 400/208 |
| 0287778 | 12/1986 | Japan | 400/229 |

OTHER PUBLICATIONS

IBM Technical Disclosure Bulletin, "Mechanical Ribbon Saver for Resistive Ribbon Printers", vol. 29, No. 11, Apr. 1987, pp. 4699–4704.

*Primary Examiner*—Ernest T. Wright, Jr.

*Attorney, Agent, or Firm*—Wilbert Hawk, Jr.; Albert L. Sessler, Jr.; George J. Muckenthaler

[57] ABSTRACT

A ribbon is driven past the printing station of a printer only when the print head is moved in the right-to-left direction across the printer. An endless timing belt causes rotation of a gear pulley that is in mesh with an idler gear. The idler gear is supported on a pair of projecting fingers of a plate that is swingable on the center of the gear pulley. The idler gear is responsive to the direction of rotation of the gear pulley through a drag effect of the projecting fingers with the bottom surface of the idler gear.

20 Claims, 5 Drawing Sheets

UNIDIRECTIONAL RIBBON DRIVE MECHANISM

BACKGROUND OF THE INVENTION

In the field of printing, the most common type printer has been the printer which impacts against record media that is caused to be moved past a printing line or line of printing. As is well-known, the impact printing operation depends upon the movement of impact members, such as print hammers or wires or the like, which are typically moved by means of an electromechanical drive system and which system enables precise control of the impact members.

In the field of dot matrix printers, it has been quite common to provide a print head which has included therein a plurality of print wire actuators or solenoids arranged or grouped in a manner to drive the respective print wires a very short, precise distance from a rest or non-printing position to an impact or printing position. The print wires are generally either secured to or engaged by the solenoid plunger or armature which is caused to be moved such precise distance when the solenoid coil is energized and wherein the plunger or armature normally operates against the acton of a return spring.

It has also been quite common to provide an arrangement or grouping of such solenoids in a circular configuration to take advantage of reduced space available in the manner of locating the print wires in that specific area between the solenoids and the front tip of the print head adjacent the record media. In this respect, the actuating ends of the print wires are positioned in accordance with the circular arrangement and the operating or working ends of the print wires are closely spaced in vertically-aligned manner adjacent the record media. The availability of narrow or compact actuators permits a narrower or smaller print head to be used and thereby reduces the width of the printer because of the reduced clearance at the ends of the print line. The print head can also be made shorter because the narrow actuators can be placed in side-by-side manner closer to the record media for a given amount of wire curvature.

In the wire matrix printer which is utilized for receipt and journal printing operation, the print head structure may be a multiple element type and may be horizontally disposed with the wire elements aligned in a vertical line and supported on a print head carriage which is caused to be moved or driven in a horizontal direction for printing in line manner across the receipt or journal paper and wherein the drive elements or transducers may be positioned in a circular configuration with the respective wires leading to the front tip of the print head. In the wire matrix printer which is utilized for business forms or like record media printing operation, the print head may be oriented in a manner wherein the nose is pointed downward for printing on the form, slip or like media while the carriage and print head are moved above and across the form or media in the horizontal direction.

In the dot matrix printer which includes a print head of the circular configuration and multiple element type, there is a requirement for driving an inking ribbon past the print head at one or both ends of travel of the print head during printing operations.

Representative documentation in the field of ribbon drive mechanisms includes U.S. Pat. No. 3,948,382, issued to D. D. Nesbitt et al. on Apr. 6, 1976, which discloses a motor-driven ribbon drive mechanism having a pivotable bar carrying a gear combination mounted so that one gear may mesh with either of two ribbon drive gears depending upon the direction of rotation of the motor.

U.S. Pat. No. 3,990,564, issued to L. L. Crump et al. on Nov. 9, 1976, discloses a ribbon drive mechanism wherein a pair of compensating wheels with overriding clutches are alternately activated to drive the ribbon in one direction regardless of the direction of travel of the print head carriage.

U.S. Pat. No. 4,416,560, issued to D. E. Wood et al. on Nov. 22, 1983, discloses a computer printer carriage control apparatus and a ribbon cassette containing an inked ribbon and ribbon feed mechanism.

U.S. Pat. No. 4,452,542, issued to H. Akazawa on June 5, 1984, discloses an endless timing belt driving a roller operably coupled with a plurality of gears for driving the ribbon in one direction.

U.S. Pat. No. 4,531,849, issued to K. Dobashi on July 30, 1985, discloses a ribbon feed mechanism having a first and a second drive gear, an output gear and an output shaft, and an idler gear held in mesh with the output gear at all times.

U.S. Pat. No. 4,596,480, issued to H. Takada on June 24, 1986, discloses a ribbon feed mechanism wherein a ribbon drive gear for feeding the ribbon is alternately meshed with two drive gears during reciprocation of the carriage to be thereby rotated in a predetermined single direction.

U.S. Pat. No. 4,712,931, issued to K. Ohshima on Dec. 15, 1987, discloses a ribbon drive mechanism that includes an endless timing belt driving a pulley connected with a gear that is swingable to engage one or another gear depending on the rotational direction of the pulley.

And, Japanese Application No. 58-191182, dated Nov. 8, 1983, discloses a drive mechanism wherein an internal gear is swung in an arc to engage with another gear arrangement for driving the ribbon in one direction.

SUMMARY OF THE INVENTION

The present invention is directed to a dot matrix printer. More particularly, the invention includes a mechanism for driving a ribbon past a line of printing during printing operation. The printer includes a bi-directional motor supported at the right-hand side of the printer for driving an endless timing belt coupled to a motor pulley and coupled to a second pulley spaced across the printer from the motor pulley. The endless belt is connected to a carriage that supports a print head which is moved across the printer in an arrangement to provide bi-directional printing.

The second pulley is supported and is journaled at the left-hand side of the printer and is a part of a gear pulley arrangement (or pulley gear configuration) that is provided to drive the inking ribbon for the printer.

The endless timing belt engages with teeth of the upper portion of the gear pulley and is held in an engaged position thereon between a lower flange portion integral with the upper portion and a flange secured on a gear pulley stud. The gear pulley has a lower gear portion which is also an integral part of the gear pulley arrangement.

An idler gear has an upper gear portion that engages with the lower gear portion of the gear pulley and is carried on projecting portions of an idler gear plate member which is journaled on the gear pulley stud. The stud is molded into the cabinet of the printer.

The idler gear includes the upper gear portion, a central portion which is partially surrounded by the idler gear plate member used as a bearing, and a lower portion which extends into an opening in the cabinet of the printer used as a stop to position gear centers and to prevent gears from jamming together.

A ribbon drive element includes a gear at the lower portion which engages with the idler gear. The drive element has an upstanding spindle portion which has an upper drive portion for engaging a drive roller in the ribbon cassette for driving the ribbon.

The idler gear is swingable to engage with and to disengage from the lower portion gear of the ribbon drive element depending upon the direction of rotation of the gear pulley. The projections on the idler gear plate on which the idler gear is supported provide a drag or frictional effect on the idler gear which depends upon the direction of rotation of the gear pulley to provide engagement and disengagement of the idler gear and the lower portion gear of the ribbon drive element.

In view of the above discussion, a principal object of the present invention is to provide a ribbon drive mechanism in a dot matrix printer.

Another object of the present invention is to provide a simplified and lower cost ribbon drive mechanism in a dot matrix printer.

An additional object of the present invention is to provide a ribbon drive mechanism that moves the ribbon past the print head in one direction of travel thereof.

A further object of the present invention is to provide a ribbon drive mechanism that includes a gear pulley driven by a timing belt that is coupled to the print head carriage and an idler gear having a plate member in contact therewith which provides a drag action on the idler gear depending upon the direction of rotation of the gear pulley.

Additional advantages and features of the present invention will become apparent and fully understood from a reading of the following description taken together with the annexed drawing.

DESCRIPTION OF THE PREFERRED EMBODIMENT

Prior to describing the structure in detail, it should be noted that the printer of the present invention is a multi-function type that can accommodate a receipt, a journal and a slip or form which form consists of one or more parts. The printer can be set in one of five different modes of operation which include printing a journal only, printing a receipt only, printing a receipt and a journal, printing a slip or form only, or printing a slip or form and a journal. The journal and the receipt can accommodate 42 columns of printing and the slip or form can accommodate 46 columns of printing.

Figure 1:
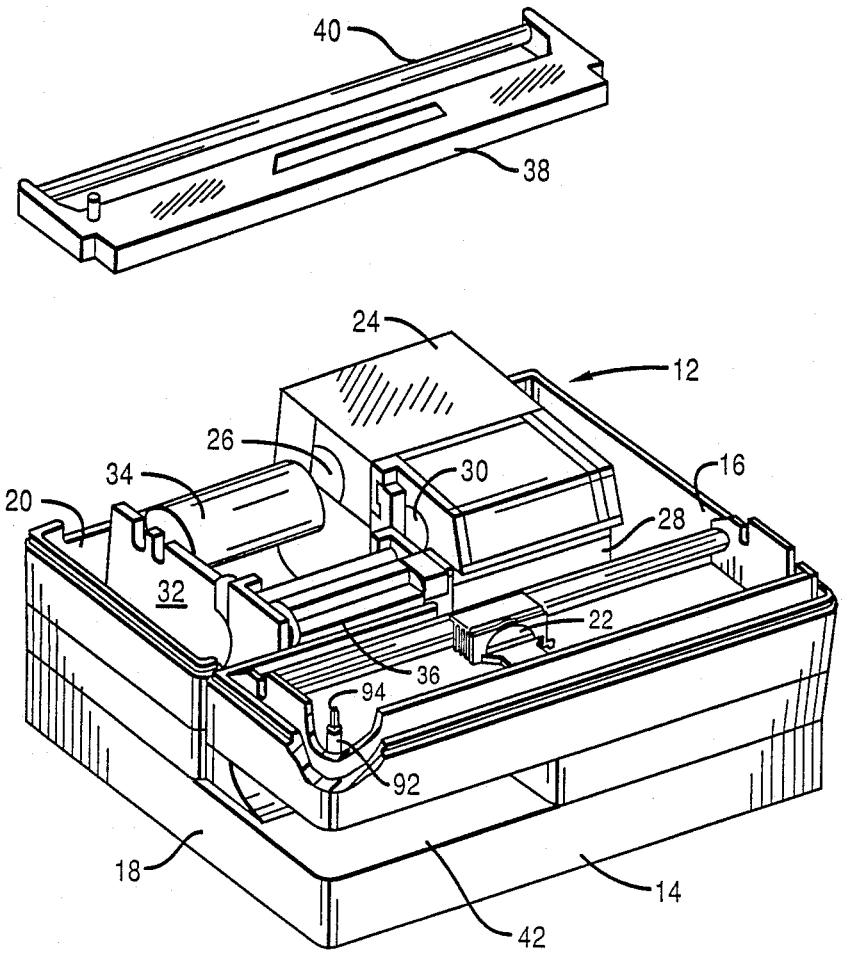
FIG. 1 is a perspective view of a printer incorporating the subject matter of the present invention.

Referring now to the drawing, FIG. 1 shows a perspective view of a printer 12 having a front portion 14, a right side 16, a left side 18, and a rear portion 20. A wire matrix print head 22 is moved in a side-to-side manner by suitable motor drive means (not shown), located at the right front corner of the printer 12. A journal station or module 24 is provided at the right hand side of the printer 12 and includes a supply roll 26 of journal paper that is guided past the journal print station platen 28 and is rewound on a take-up roller 30 by a step-type drive motor (not shown).

A receipt station or module 32 is provided at the left hand side of the printer 12 and includes a supply roll 34 of receipt paper that is guided past the receipt print station platen 36 and is driven by a step-type drive motor (not shown). The journal station 24 and the receipt station 32 are separated by six character spaces. A ribbon cassette 38 of the operator-changeable type is positioned to the rear of the print head 22 (toward the viewer of the illustration in FIG. 1) and the ribbon 40 is driven in one direction from right to left in a path between the front portion of the print head 22 and the record media (journal, receipt or slip). A slot 42 is provided at the left front side for insertion of the slip which can be inserted from the front of the printer 12, from the side thereof or from the top in a path in front of the receipt paper at the receipt station 32.

Figure 2:
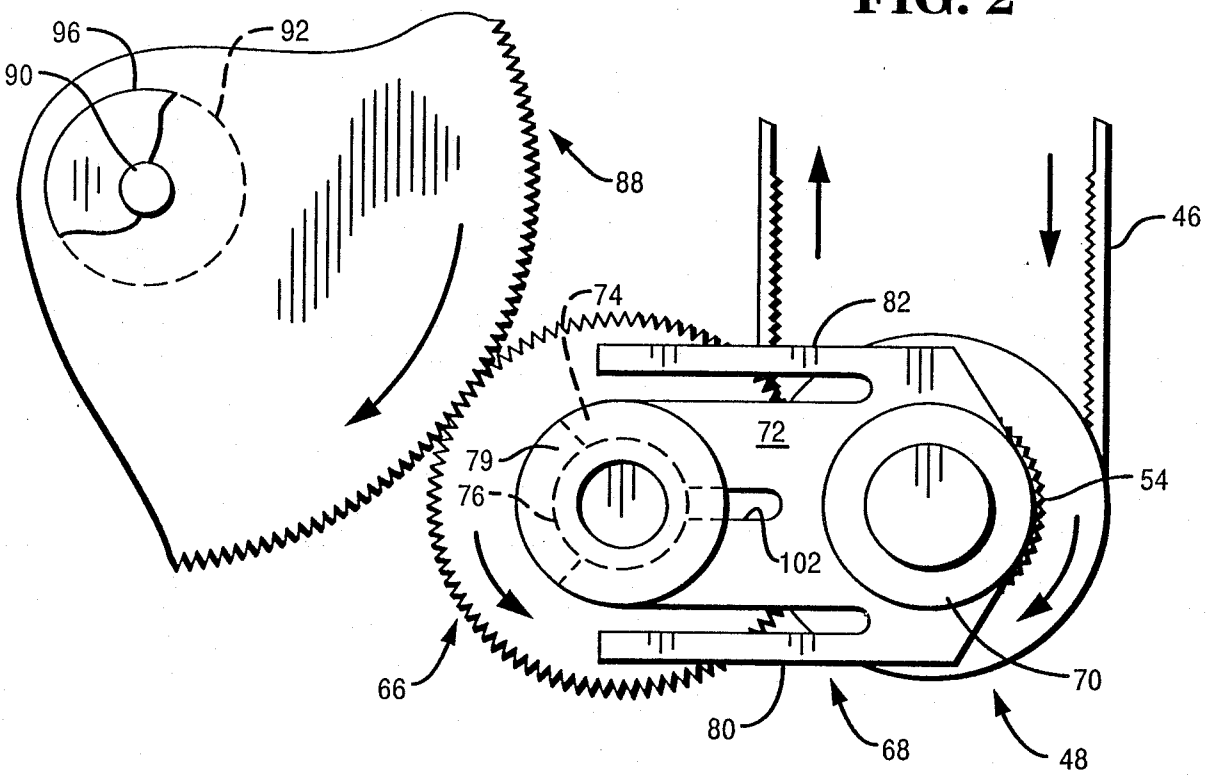
FIG. 2 is a view taken along the line 2—2 of FIG. 3, less a lower frame portion of the printer which supports the ribbon drive mechanism.
Figures 3, 5:
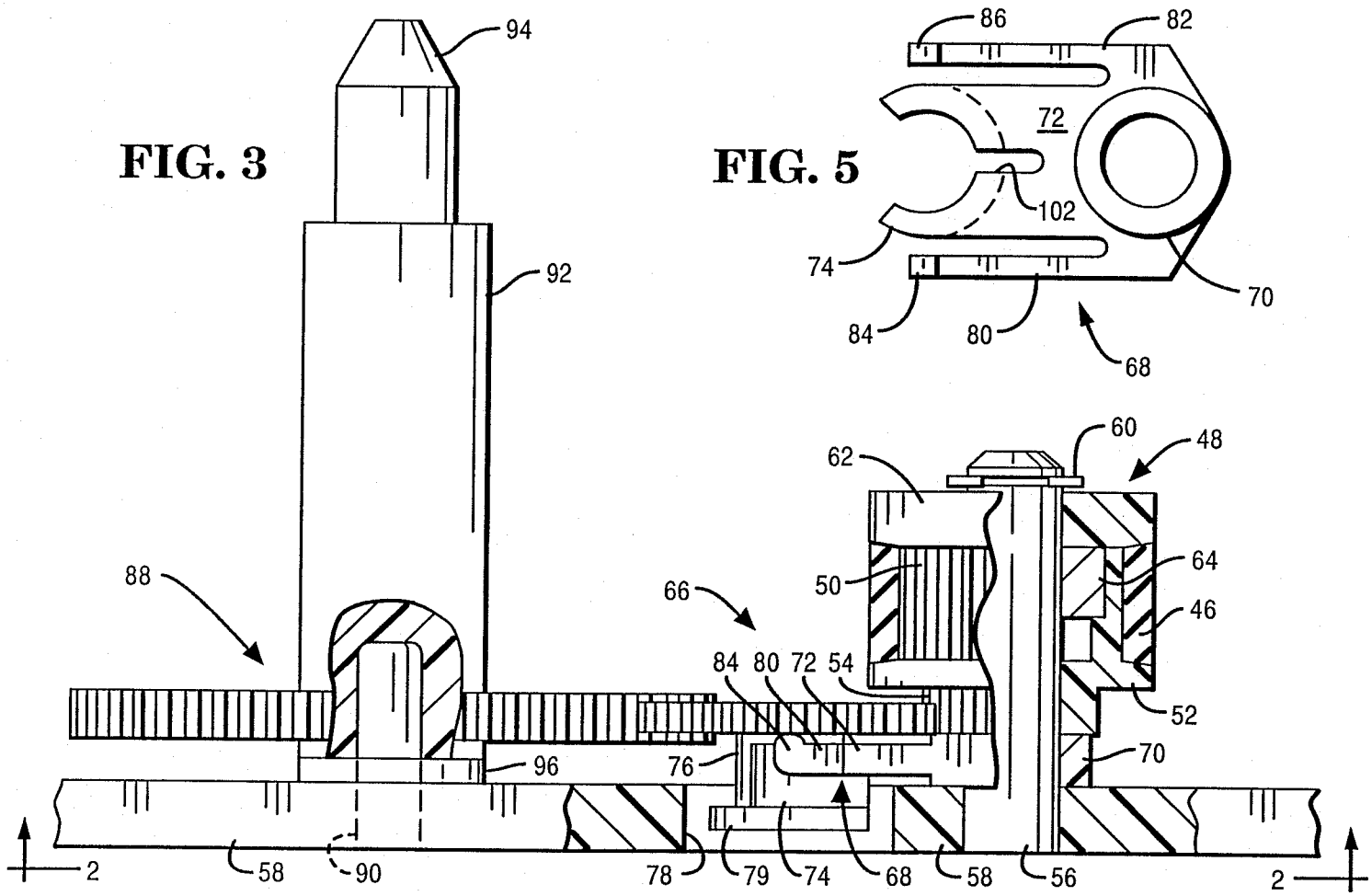
FIG. 3 is a side elevational view of the ribbon drive mechanism.
FIG. 5 is a top view of the idler gear plate member.

FIGS. 2 and 3 illustrate the ribbon drive mechanism of the present invention wherein an endless timing belt 46 driven by the print head motor drive means (not shown) is trained around a gear pulley generally designated as 48. The gear pulley 48 includes an upper gear portion 50 around which the timing belt 46 is in mesh, a flange portion 52 adjacent the upper gear portion 50, and a lower gear portion 54. A pin or stud 56 is molded into the frame 58 of the printer 12 and extends upwardly through the lower gear portion 54, the flange portion 52 and the upper gear portion 50. An E clip 60 is provided around the stud 56 and above a top flange 62 to hold the several parts in position. A ball bearing 64 is provided within the gear pulley 48 for journaling the upper gear portion 50 on the stud 56.

An idler gear, generally designated as 66, is provided adjacent the gear pulley 48 to mesh with the lower gear portion 54 of the gear pulley 48. An idler gear plate 68 (see also FIG. 5) has a hub portion 70 for bearing on the stud 56 and has an extending or projecting central portion 72 which has an arcuate portion 74 for engaging with a middle portion 76 of the idler gear 66. The arcuate portion 74 extends about two-thirds around the circumference of the middle portion 76 of the idler gear 66. The frame 58 includes an opening 78 for a lower flange portion 79 of the idler gear 66. The opening 78 is of sufficient size to enable sideways movement of the lower flange portion 79 when the idler gear 66 is caused to be swung in a horizontal direction.

The idler gear plate 68 includes two spring elements or fingers 80 and 82 extending in the same direction as the central portion 72 but bifurcated therefrom. The finger 80 has an upwardly extending, rounded projection 84 and the finger 82 has a like upwardly extending, rounded projection 86. The projections 84 and 86 are positioned on the centerline of and support the idler gear 66.

A cassette drive gear, generally designated as 88, is mounted on a stud or pin 90 that is molded into the frame 58 of the printer 12. A drive spindle 92 is integral with the drive gear 88 and includes a drive portion 94 that extends upwardly to engage with a drive member (not shown) of the cassette 38. The frame 58 of the printer 12 has a ridge or raised portion 96 for supporting the drive gear 88 at the proper level to mesh with the idler gear 66.

Figure 4:
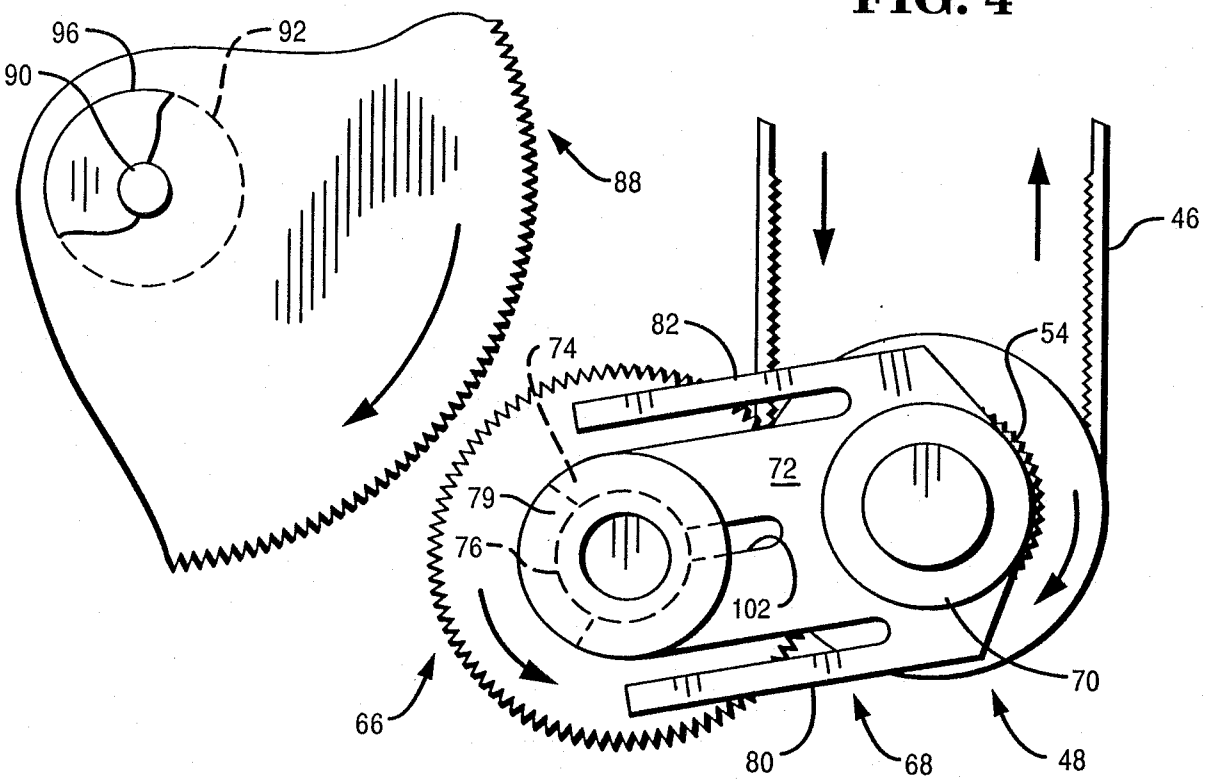
FIG. 4 is a view similar to FIG. 2 and showing certain parts in a disengaged position.

While FIG. 2 shows the ribbon drive mechanism in position for driving the ribbon 40, FIG. 4 is a similar view and is provided to show the mechanism in a ribbon non-driving position.

FIG. 5 shows a top view of the idler gear plate member 68 and illustrates the spring fingers 80, 82 with the rounded projections 84, 86 at the ends of the fingers 80, 82. The rounded projections 84, 86 provide a support for the idler gear 66 and effect a drag on the idler gear 66 when the idler gear 66 is swung on the pivot stud 56 by rotation of the gear pulley 48.

FIG. 5 also shows the slot 102 in the idler gear plate member 68 which enables and provides a spring effect for the arcuate portion 74 of the plate member 68 to partially surround the middle portion 76 of the idler gear 66.

Figure 6:
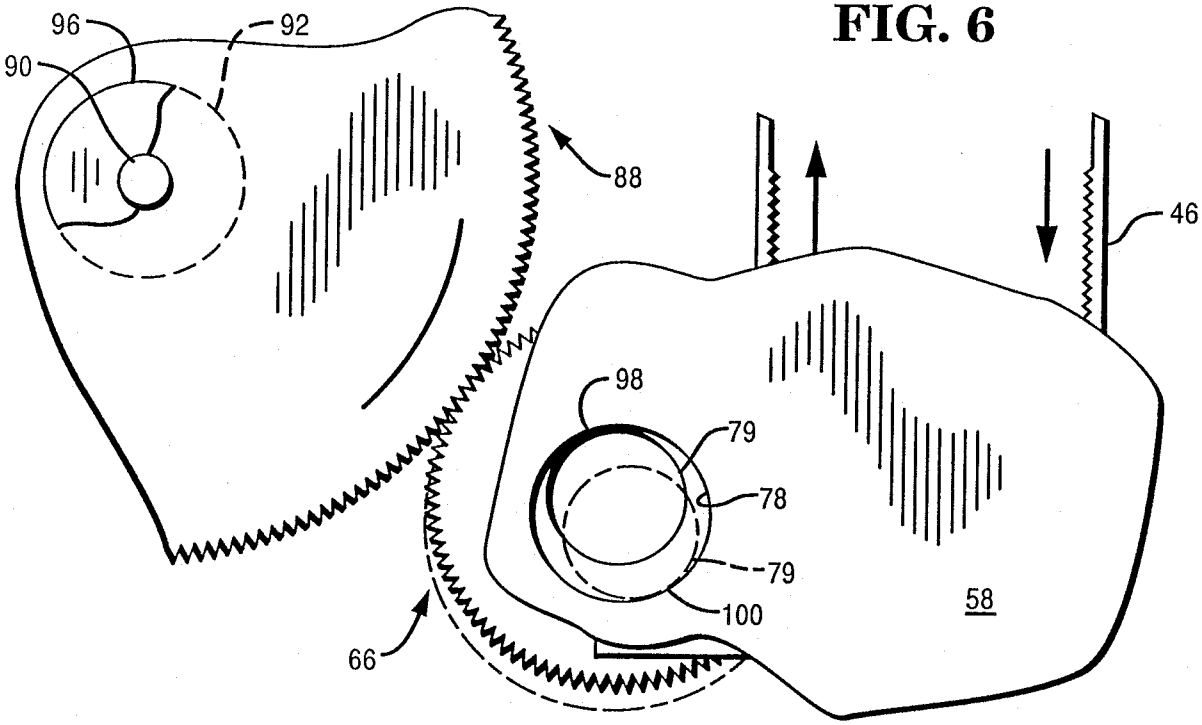
FIG. 6 is a view showing two positions of the lower flange portion of the idler gear.

FIG. 6 is a view showing the aperture or opening 78 in the frame 58 of the printer 12 and the two positions of the lower flange portion 79 of the idler gear 66. The flange portion 79 is swung against one edge 98 of the opening 78 when the idler gear 66 is fully engaged with the cassette drive gear 88 and the flange portion 79 is swung against the opposite edge 100 of the opening 78 when the idler gear is disengaged from the drive gear 88.

In the operation of the ribbon drive mechanism, when the print head 22 moves from right to left across the printer 12, the cassette drive gear 88 drives the ribbon 40. As illustrated in FIG. 2, which is looking in the direction of line 2—2 of FIG. 3 or from the bottom of the ribbon drive mechanism, the timing belt 46 causes clockwise rotation of the gear pulley 48 and counterclockwise rotation of the idler gear 66. The cassette drive gear 88 is driven in a clockwise direction by the idler gear 66 and the spindle 92 is driven in the same direction for driving or advancing the ribbon 40 past the printing station.

The movement of the timing belt 46 and the clockwise rotation of the gear pulley 48 provides for and effects a drag on the idler gear 66 through the projections 84 and 86 supporting the idler gear 66. This drag effect causes the idler gear 66 to swing in a clockwise direction around the center of the gear pulley 48 on the stud 56 and to swing into mesh position with the drive gear 88.

When the print head 22 moves from left to right across the printer 12, the cassette drive gear 88 is not driven and the ribbon 40 is stationary. As seen in FIG. 4, the timing belt 46 causes counterclockwise rotation of the gear pulley 48 and the idler gear 66 is swung in a counterclockwise direction around the center of the gear pulley 48 on the stud 56 by means of the drag effect through the projections 84 and 86 of the idler gear plate 68 with the bottom surface of the idler gear 66. The idler gear 66 is swung out of mesh with the ribbon drive gear 88 with the result that the ribbon 40 is not driven when the print head 22 is moved from left to right.

The swinging movement or amount of swing of the idler gear 66 is controlled or limited by the size of the circular recess or opening 78 relative to the lower flange portion 79 of the idler gear 66. FIG. 6 shows the opening 78 and the extent of travel of the lower flange portion 79 from one side or edge 98 of the opening 78 to the other side or edge 100. The opening 78 is sized to limit the travel of the idler gear 66 when it swings out of mesh with the ribbon drive gear 88 (FIG. 4) and also prevents overmesh or excessive mesh with the ribbon drive gear 88 (FIG. 2) during the cycle of ribbon feed or advance.

The ribbon 40 is driven or advanced only when the print head 22 is driven from right to left and the ribbon 40 is stationary in the opposite direction of travel of the print head 22.

It is thus seen that herein shown and described is a ribbon drive mechanism that is responsive to direction of travel of the print head and wherein the ribbon 40 is driven or advanced during only one direction of print head travel. The mechanism and arrangement enable the accomplishment of the objects and advantages mentioned above, and while a preferred embodiment of the invention has been disclosed herein, variations thereof may occur to those skilled in the art. It is contemplated that all such variations not departing from the spirit and scope of the invention hereof are to be construed in accordance with the following claims.

What is claimed is:

1. Mechanism for driving a ribbon in a printer having a frame, said mechanism comprising an endless timing belt driven in reciprocating manner across said printer, a gear pulley engaged with said endless timing belt and rotatable about a pivot in either a clockwise or a counterclockwise direction in response to the direction of travel of said timing belt, an idler gear engaged with said gear pulley and operably associated in mesh relationship therewith, an idler gear support member swingable on said pivot and responsive to the direction of rotation of said gear pulley, said support member including projecting means engaging one surface of said idler gear to provide a drag effect thereon in opposition to rotation of said idler gear produced by rotation of said gear pulley, and a ribbon drive member comprising a drive gear in position to mesh with said idler gear and to drive said ribbon upon swinging of said idler gear in response to rotation of said gear pulley in one direction.

2. The mechanism of claim 1 wherein said gear pulley includes a pulley portion and a gear portion integral therewith.

3. The mechanism of claim 2 wherein said gear pulley includes means for bearing said pulley portion.

4. The mechanism of claim 1 wherein said idler gear support member includes a hub portion and an extended portion having spaced spring elements carrying said projecting means for supporting said idler gear.

5. The mechanism of claim 1 wherein said idler gear includes a central portion and said support member includes a hub portion and a central portion extending in planar manner from said hub portion for encircling part of the circumference of the central portion of said idler gear.

6. The mechanism of claim 1 wherein said idler gear support member includes a hub portion and a central portion extending in planar manner from said hub portion and further includes a pair of spring elements carrying said projecting means.

7. The mechanism of claim 1 wherein said ribbon drive member includes a spindle integral with the drive gear and operably associated with said idler gear for driving said ribbon.

8. The mechanism of claim 1 wherein said frame includes an opening therein for receiving said idler gear and sized to limit the amount of swinging of said idler gear in response to rotation of said gear pulley.

9. The mechanism of claim 1 wherein said frame includes an opening therein and said idler gear includes a central portion engageable with said support member and a flange portion positioned in said opening, said opening being sized to permit swinging of said flange portion but to limit the amount of swinging thereof in response to rotation of said gear pulley.

10. A printer having a frame and a print head movable in transverse direction, means for moving said print head in said direction, a ribbon cassette containing an endless ribbon operably associated with said print head, and means for advancing said ribbon past said print head during one direction of travel thereof, said ribbon advancing means comprising drive spindle means operably associated with said ribbon cassette, gear pulley means operably associated with said print head moving means, idler gear means operably associated with said gear pulley means and with said drive spindle means, and idler gear plate means engageable with said idler gear means and including projecting elements for effecting a drag on said idler gear means for swinging thereof into and out of mesh with said spindle gear means depending upon the direction of rotation of said gear pulley means.

11. The printer of claim 10 wherein said print head moving means comprises an endless timing belt.

12. The printer of claim 10 wherein said drive spindle means comprises a spindle member and a gear integral therewith.

13. The printer of claim 10 wherein said gear pulley means includes an upper toothed portion engaging said print head moving means, a gear portion continuously engaging said idler gear means, and pin means for supporting said upper toothed portion, said gear portion, and said idler gear plate means, said pin means providing a pivot for said idler gear plate means.

14. The printer of claim 10 wherein said idler gear plate means comprises a hub portion and an extending portion integral with the hub portion and partially surrounding said idler gear means, and spaced fingers carrying said projecting elements in contact with the lower surface of said idler gear means.

15. The printer of claim 10 wherein said idler gear means comprises an upper gear portion, a control hub portion engageable with said idler gear plate means, and a lower flange portion engageable with the frame of said printer for limiting the amount of swinging of said idler gear means.

16. The printer of claim 10 wherein said frame defines an opening therein for receiving a portion of said idler gear means and for limiting swinging thereof.

17. The printer of claim 10 wherein said idler gear plate means includes a hub portion, an extended portion integral with the hub portion and spaced fingers bifurcated with said extended portion and carrying said projecting elements engaging a lower surface of the idler gear means.

18. The printer of claim 10 wherein said idler gear plate means includes a hub portion axially aligned with said gear pulley means, an extended portion integral with the hub portion, and spaced spring fingers carrying said projecting elements oppositely positioned from an axis of said idler gear means.

19. In a printer having a frame, a print head movable in transverse manner across the printer, belt means for moving the print head in said manner, and a ribbon cassette positioned to provide a ribbon adjacent the print head for printing operation, the improvement comprising ribbon drive mechanism including drive gear means operably associated with said cassette for driving the ribbon past said print head, gear pulley means engaged with said belt means to be rotated thereby about a pivot in either a clockwise or a counterclockwise direction in response to the direction of movement of said print head, and idler gear means swingable about said pivot and responsive to the direction of rotation of said gear pulley means, said idler gear means being supported by projecting means on said gear pulley means effecting a drag on said idler gear means for swinging thereof into and out of engagement with said drive gear means.

20. In the printer of claim 19 wherein said idler gear means includes a plate member operably associated with said gear pulley means and responsive to clockwise and counterclockwise rotation thereof for swinging about said pivot and includes spaced spring members having the projecting means thereon for effecting a drag on said idler gear means to engage with and disengage from said drive gear means.

* * * * *